US005647762A

United States Patent [19]

Fukuda

[11] Patent Number: 5,647,762

[45] Date of Patent: Jul. 15, 1997

[54] LOCKING STRUCTURE OF SHORT-CIRCUIT CONTACT FOR CONNECTORS

[75] Inventor: Eiji Fukuda, Haibara-gun, Japan

[73] Assignee: Yazaki Corporation, Tokyo, Japan

[21] Appl. No.: 543,825

[22] Filed: Oct. 16, 1995

[30] Foreign Application Priority Data

Nov. 18, 1994 [JP] Japan ..... 6-284976

[51] Int. Cl.[6] ..... H01R 3/00

[52] U.S. Cl. ..... 439/489; 439/188

[58] Field of Search ..... 439/488, 489, 439/490, 188; 200/51.09–51.11

[56] References Cited

U.S. PATENT DOCUMENTS 4,284,320 8/1981 Nix et al. ..... 439/752
4,867,712 9/1989 Kato et al. ..... 439/752
5,376,017 12/1994 Taniuchi et al. ..... 439/489
5,464,353 11/1995 Saijo et al. ..... 439/489

FOREIGN PATENT DOCUMENTS 4-23391 1/1992 Japan .

*Primary Examiner*—Hien Vu
*Attorney, Agent, or Firm*—Armstrong, Westerman, Hattori, McLeland & Naughton

[57] ABSTRACT

A short-circuit contact is doubly locked by providing a locking protrusion at a cover plate of the short-circuit contact mounted on one connector housing, engaging the locking protrusion with a locking recess provided at a contact-support chamber of the one connector housing to primarily lock the short-circuit contact, engaging the insert locking piece into a locking piece insertion hole provided at the one connector housing to engage a locking protrusion of the insert locking piece with the base plate of the short-circuit contact, thereby secondarily locking the short-circuit contact.

5 Claims, 5 Drawing Sheets

LOCKING STRUCTURE OF SHORT-CIRCUIT CONTACT FOR CONNECTORS

BACKGROUND OF THE INVENTION

1. Field of the Invention

This invention relates to a locking structure of a short-circuit contact for a connector having a connections sensor usable as a connector in an air bag system mainly installed in a motor vehicle.

2. Description of the Prior Art

A terminal of a connector has been secured generally by providing an upraised portion integrally at the terminal and engaging the terminal with a bottom wall of a terminal receiving chamber of a connector housing or engaging a flexible lock arm, which is formed integrally on a ceiling wall of the terminal receiving chamber, with the terminal at a shoulder or a hole of an electric contact thereof.

However, since the upraised lock arm has been easily damaged because of the smallness of its size, and has disadvantages such as an easy drop out of the terminal, poor contacting and the like.

Therefore, a connector K having a double locking structure, as shown in FIGS. 7 and 8, has been proposed in Japanese Patent Application Laid Open No. 4-23391.

The connector K disclosed in the above publication has the double locking structure in which a lock arm d provided at the interior of a terminal receiving chamber b is engaged with a locking hole e of a terminal c contained in the terminal receiving chamber b of a connector housing a to provide a primary locking, then an insert pin f is inserted into the connector housing a in a vertical direction, and then a protrusion g of the insert pin f is engaged with a locking portion h of the terminal c to provide a secondary locking.

On the other hand, the applicant of the present patent application has already proposed, in a Japanese Patent Application Ser. No. 5-289153, a connector K' having a connection sensor shown in FIG. 9 as a connector adapted for use in an air bag system to be installed in a motor vehicle.

The connector K' has a short-circuit contact j shown in FIG. 10 which is mounted at one connector housing i, and a pair of connection sensing terminals m which are contained at the other connector housing k.

As shown in FIG. 11, when the connector housing i is insufficiently engaged with the connector housing k, the short-circuit contact j is bent as being pressed by a locking arm o of the connector housing i, and the short-circuit contact j is not brought into contact with the pair of connection sensing terminals m, thereby the pair of connection sensing terminals m are held at a state of cut-off.

As shown in FIG. 12, when the connector housing i is completely engaged with the connector housing k, the lock arm o is returned to its original position, and the short-circuit contact j, FIG. 19 is brought into contact with the pair of connection sensing terminals m. As a result, since the pair of connection sensing terminals m, m are electrically conducted with each other through the short-circuit contact j, the engagement of the connector housing i and the connector housing k is detected by detecting said conduction of the pair of connection sensing terminals by means of an electric circuit.

However, in the connector K', FIG. 9, described above, the means for fastening the short-circuit contact j on the connector housing i is provided only by engaging the coupling protrusion n at the side of the short-circuit contact j with a coupling portion provided at the connector housing i. Therefore, the short-circuit contact j has disadvantages such that it is easily removed from the connector housing i and then making it impossible to detect the engagement of the connector housings, and this results in a decrease of reliability. Accordingly, even if the locking structure of the insert pin f, FIG. 7, of said connector K is intended to use in the short-circuit contact j in order to fasten it firmly, there is a problem such that the application of the insert pin f is practically difficult due to a structural problem of the connector housing i for use in the air bag system.

SUMMARY OF THE INVENTION

It is therefore an object of the present invention is to provide a locking structure of a short-circuit contact for a connector which eliminates the problems encountered with the prior art connectors, whereby the short-circuit contact can be reliably held by forming the locking structure of the short-circuit contact for the connector having a connection sensing unit into a double locking structure, and the high reliability and advantageous assembling operability can be provided.

In order to achieve the above-described objective, the locking structure of the short-circuit contact of the present invention comprises a short-circuit contact mounted on one connector housing of a pair of connector housings to be engaged with each other, a pair of connection sensing terminals provided at the other connector housing, and a connection sensor in which the pair of connection sensing terminals are brought into contact respectively with the short-circuit contact for electrical conduction when the both connector housings are completely engaged with each other, wherein a locking piece insertion hole is provided at a contact-support chamber of said one connector housing, a portion of said short-circuit contact is secured to said contact-support chamber and, by inserting a locking piece having a locking protrusion into said locking piece insertion hole, said short-circuit contact and said locking protrusion are contacted with each other for locking the contact.

Another aspect of the present invention, it is preferable for the locking structure of the short-circuit contact for the connector to comprise a locking recess provided at the contact-support chamber of the one connector housing, whereby the locking is provided by engaging the locking protrusion of the short-circuit contact with the locking recess of the contact-support chamber of said connector housings.

Still another aspect of the present invention, the locking structure of the short-circuit contact for the connector secures a portion of the short-circuit contact to the contact-support chamber of said connector housings by force fit.

Yet another aspect of the present invention, the locking structure of the short-circuit contact for the connector further comprises cantilever type elastic contact pieces formed by folding back a base plate in an arc shape and arranged in parallel with each other with a slit therebetween, a short-circuit contact provided at an intermediate portion of each of said elastic contact pieces and an upraised portion provided at the free end of each contact piece, wherein the locking protrusion is provided at a cover plate formed by bending the base plate.

According to the present invention, the portion of the short-circuit contact which forms a part of the connection sensor of the connector is secured to the contact-support chamber of the connector housing to provide a primary locking, and the insert locking piece inserted into the locking piece insertion hole of the contact-support chamber is engaged with the short-circuit contact to provide a secondary locking.

Therefore, the short-circuit contact is locked doubly to the connector housing, and an accident such as the drop out of the short-circuit contact from the connector housing can effectively be prevented from causing.

The primary locking can be performed by providing the locking protrusion at the short-circuit contact and engaging the locking protrusion with the locking recess provided at the contact-support chamber of the connector housing. It is also effective to provide the primary locking by securing a portion of the short-circuit contact such as, the cover plate thereof, to the contact-support chamber by force fit.

Further, if the short-circuit contact is not mounted at a predetermined position of the contact-support chamber of the connector housing, i.e., in a state of incomplete mounting, since the insertion of the locking piece cannot be reached to the predetermined position of the locking piece insertion hole of the connector housing, such incomplete mounting is immediately found and a trouble to be caused by such improper mounting can be nipped in the bud, and operability in assembling process as well as reliability of a product are considerably improved.

DESCRIPTION OF THE PREFERRED EMBODIMENTS

Figure 1:
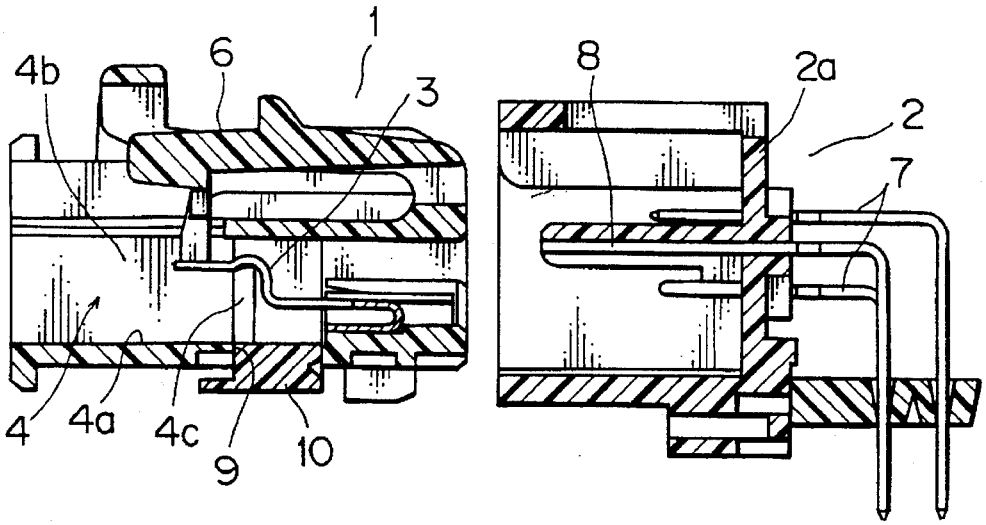
FIG. 1 is a sectional view showing one connector housing and the other connector housing according to an embodiment of the present invention.
Figure 2:
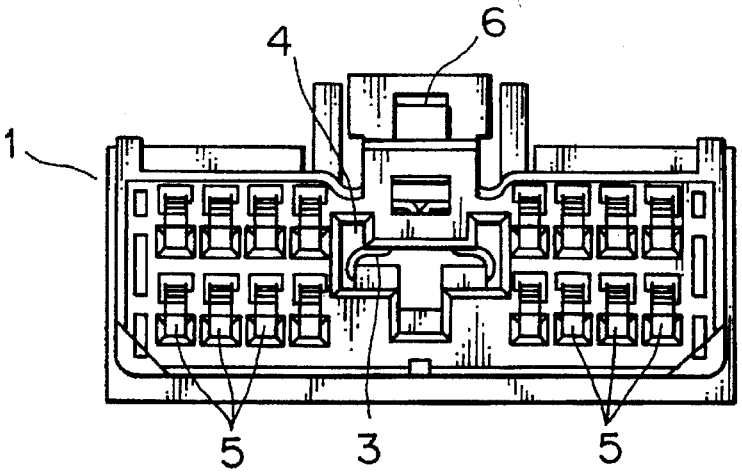
FIG. 2 is a front view of the one connector housing of FIG. 1.

Now referring to FIG. 1, there is shown a sectional view of a connector formed of one connector housing 1 and the other connector housing 2 having a connection sensor embodying the present invention. FIG. 2 is a front view of the one connector housing 1 of the connector of FIG. 1.

The connector housing 1 and connector housing 2 constitute a pair of connector housings. Both the connector housings 1 and 2 are formed of molded synthetic resin and the connector housing 1 is formed into a male type and that the connector housing 2 into a female type.

Figure 3:
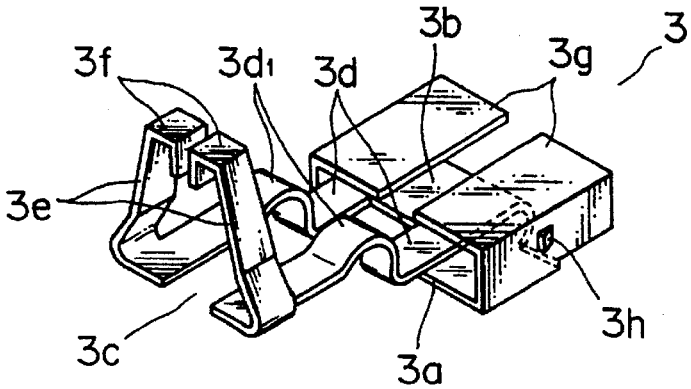
FIG. 3 a perspective view showing a short-circuit contact to be mounted on the one connector housing of FIG. 1.

A contact-support chamber 4 is provided at the central part of the connector housing 1 for accommodating a short-circuit contact 3 as shown in FIG. 3, and a plurality of terminal receiving chambers 5 are formed at both sides of the contact-support chamber 4. A locking arm 6 is provided at an upper portion of the connector housing 1 and arranged in such that the short-circuit contact is displaced elastically in a vertical direction by the pressing of the locking arm 6.

A plurality of male terminals 7 to be engaged with female terminals (not shown) contained in the terminal receiving chambers 5 are loaded from the back of the connector housing 2 through a rear wall. A pair of pin-shaped connection sensing terminals 8 are provided, separately from the male terminals 7, in parallel with each other and are brought into electrical conduction by the short-circuit contact 3 when the connector housings are engaged.

The short-circuit contact 3 is formed by bending an elastic metal plate. As shown in FIG. 3, there are provided an elastic plate **3*b* folded back in an arc shape from a base plate 3*a*, and forked cantilever type elastic contact pieces 3*d*, 3*d* extended from the elastic plate 3*b* and aligned side by side with a slit 3*c* therebetween. Upraised pieces 3*e*, 3*e* are raised upwards from outer side of the free ends of the elastic contact pieces 3*d*, 3*d*, and driven portions 3*f*, 3*f* are provided at the tip ends of the upraised pieces 3*e*, 3*e***.

A bent elastic contact **3*d*, is formed at an intermediate portion of each elastic contact piece 3*d*. When both the connector housings 1 and 2 are engaged, the elastic contact $3d_1$ shorts the pair of pin-shaped connector sensing terminals 8**.

The base plate **3*a* is bent at both sides to form cover plates 3*g*, 3*g* over the elastic plate 3*b*. A locking protrusion 3*h* is provided at respective side of the cover plates 3*g*, 3*g* for primarily locking the short-circuit contact 3 to the contact-support chamber 4**.

Figure 4:
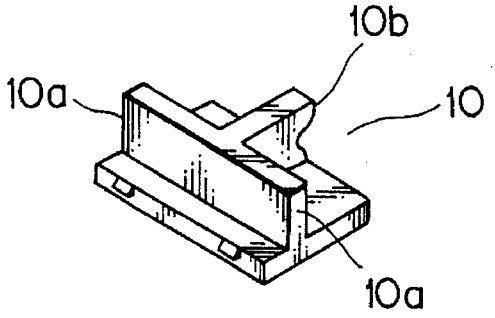
FIG. 4 is a perspective view of an insertion locking piece to be mounted on the one connector housing of FIG. 1.

A locking piece insertion hole 9 is provided at a bottom wall **4*a* of the contact-support chamber 4 of the connector housing 1. An insert locking piece 10, as shown in FIG. 4, is inserted into the contact-support chamber through the locking piece insertion hole 9 to provide the secondary locking of the short-circuit contact 3**.

Figure 5:
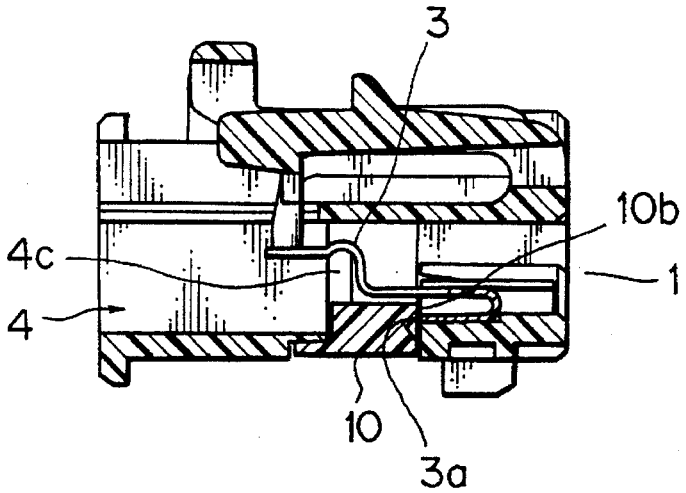
FIG. 5 is a sectional view showing a state of locking of the short-circuit contact of FIG. 1 locked by the insert locking piece.
Figure 6:
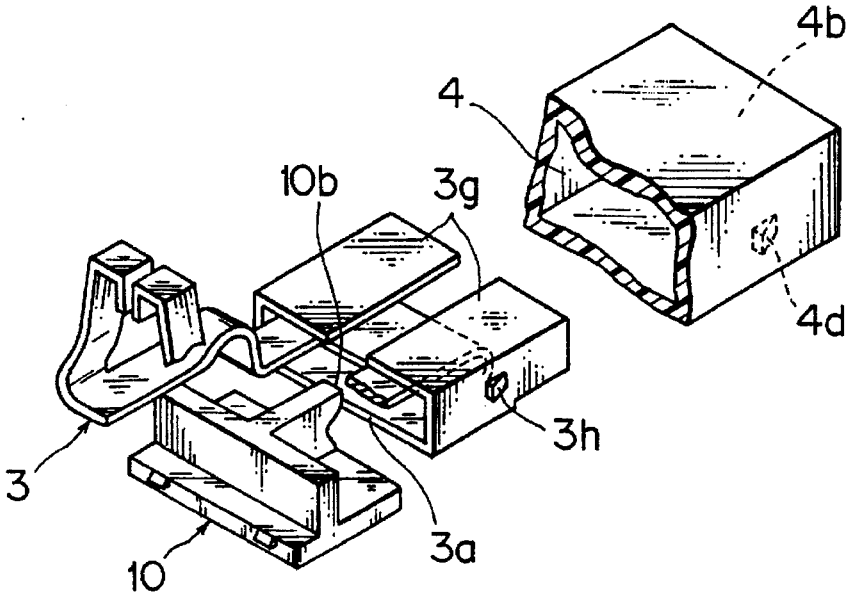
FIG. 6 is an explanatory view of a state of locking of the short-circuit contact shown in FIG. 5 locked by the insert locking piece.
Figure 7:
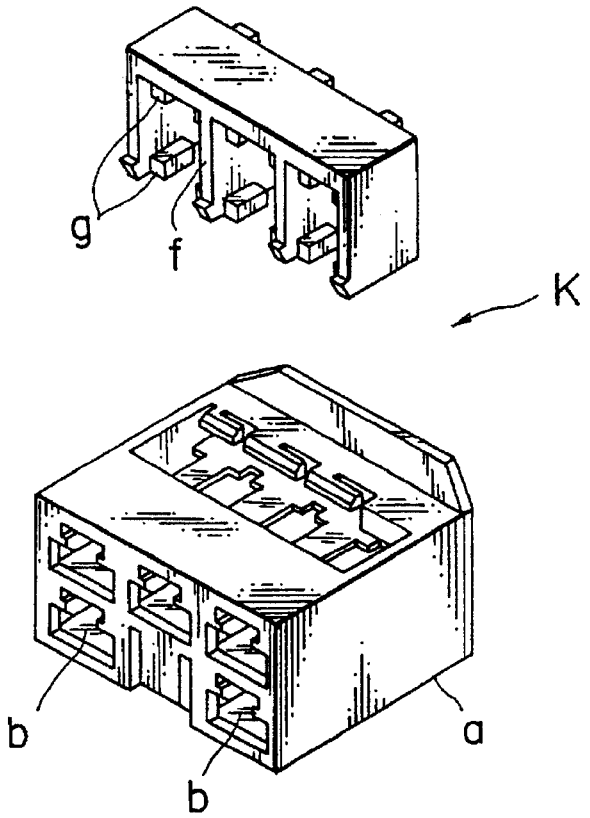
FIG. 7 PRIOR ART
FIG. 7 is a perspective view of the connector housing having a conventional double locking structure.
Figure 8:
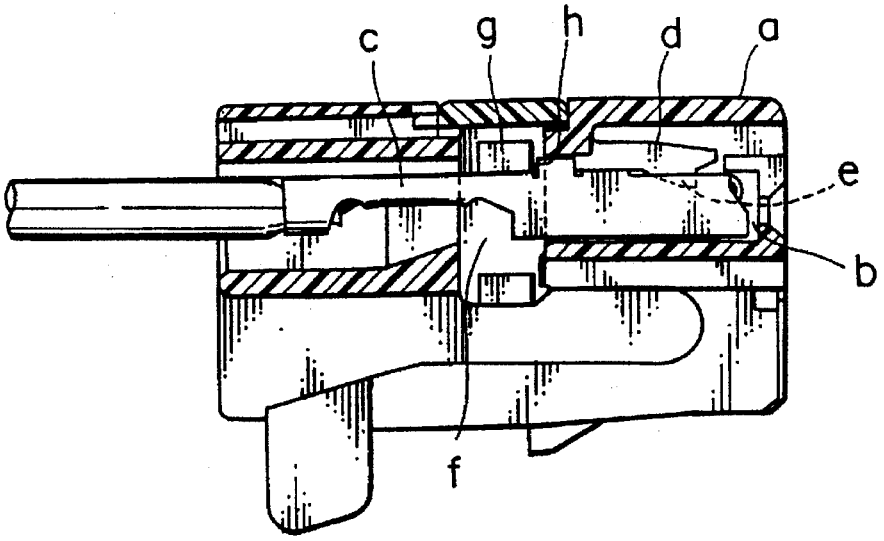
FIG. 8 PRIOR ART
FIG. 8 is a sectional view showing a state of locking of a terminal mounted in the connector housing of FIG. 7.
Figure 9:
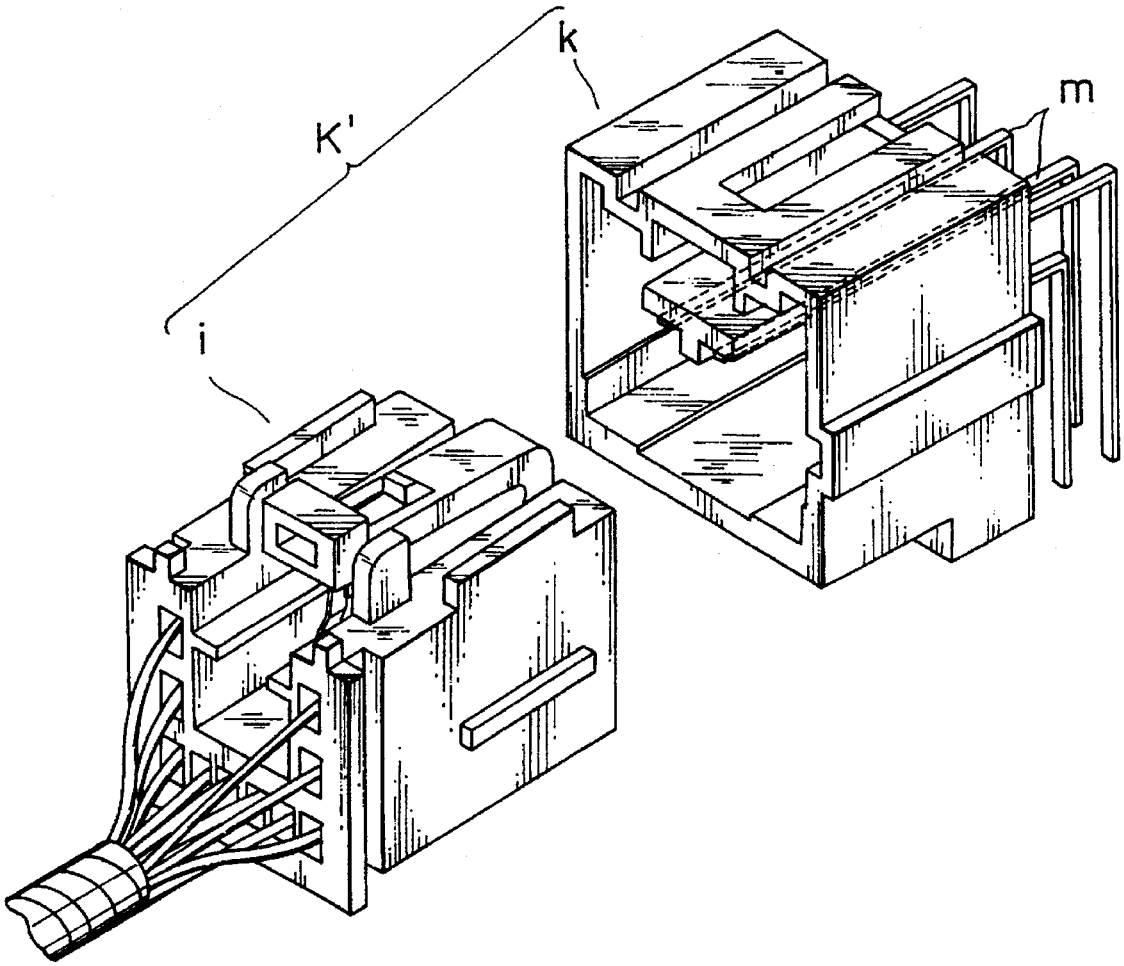
FIG. 9 PRIOR ART
FIG. 9 is a perspective view of the connector having a conventional connection sensor.
Figure 10:
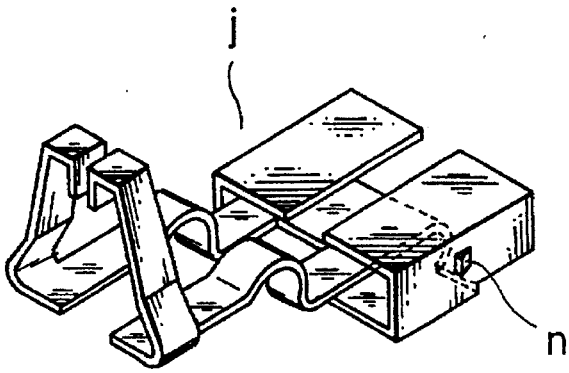
FIG. 10 PRIOR ART
FIG. 10 is a perspective view showing a short-circuit contact to be mounted in the one connector housing of FIG. 9.
Figure 11:
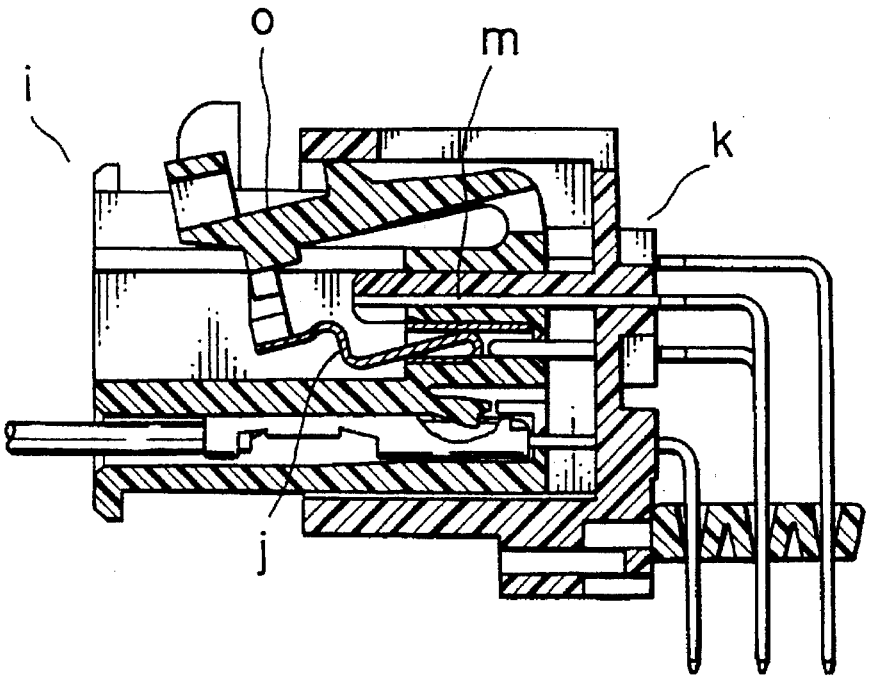
FIG. 11 PRIOR ART
FIG. 11 is a sectional view showing a state of incomplete engagement of the connector housings of FIG. 9.
Figure 12:
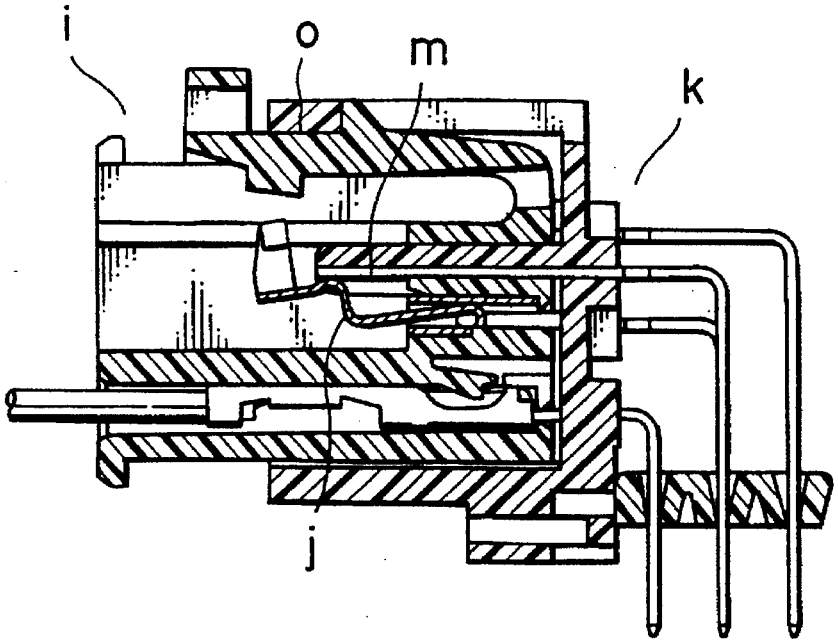
FIG. 12 PRIOR ART
FIG. 12 is a sectional view showing a state of engagement of the connector housings of FIG. 11 when they are completely engaged.

More specifically, slide edges **10*a*, 10*a* of the insert locking piece 10 are aligned with guide grooves 4*c* of the contact-support chamber 4 and inserted whereinto. As shown in FIGS. 5 and 6, a locking portion 10*b* of the insert locking piece 10 is contacted with the edge of the base plate 3*a* of the short-circuit contact 3 for locking the short-circuit contact 3 firmly in connect or housing 1. Thus, the removal of the short-circuit contact 3 from the contact-support chamber 4 is reliably prevented. On the other hand, the locking protrusion 3*h* of the short-circuit contact 3 is engaged with the respective locking recess 4*d*, FIG. 6, provided at the sidewall of the contact-support chamber 4, thereby the primary locking of the short-circuit contact 3 can be provided. Therefore, the short-circuit contact 3 is doubly locked by the locking protrusions 3*h*, 3*h* of the cover plates 3*g*, 3*g* and the insert locking piece 10**.

In the embodiment described above, the short-circuit contact 3 is provided with the locking protrusions **3*h* to engage with the locking recesses 4*d* of the contact-support chamber 4 for providing the primary locking of the short-circuit contact 3. However, the present invention is not limited to this particular embodiment. For example, the cover plates 3*g* of the short-circuit contact 3 may be secured to the contact-support chamber 4 by force fit for providing the primary locking of the short-circuit contact 3**.

According to the present invention as described above, the portion of the short-circuit contact is locked to the contact-support chamber of the connector housing for providing primary locking of the short-circuit contact, and the insert locking piece 10 fitted into the locking piece insertion hole 4 of the contact-support chamber for providing the secondary locking of the short-circuit contact. Therefore, since the short-circuit contact is doubly locked to the connector housing, an accident such as the drop out of the short-circuit contact from the connector housing can reliably be prevented.

Further, since the insert locking piece cannot be mounted in such a condition that the short-circuit contact is incompletely mounted, the incomplete mounting of the short-circuit contact can be found immediately. Accordingly, trouble caused by the improper mounting of the short-circuit contact can be prevented and the operability in assembling processes, as well as reliability of a product, are considerably improved.

What is claimed is:

1. A locking structure for doubly locking a short-circuit contact which forms a part of a connection sensor of an electrical connector having a pair of electrical connector housings comprising:

said short-circuit contact having elastic contact pieces and a base plate, said base plate primarily locked to one connector housing of said pair of electrical connector housings by locking means;

a pair of connection sensing terminals mounted in the other connector housing of said pair of connector housings engaging with said elastic contact pieces of said short-circuit contact when said pair of electrical connector housings are completely engaged;

said one connector housing of said pair of connector housings further comprising a contact support chamber to receive said short-circuit contact and a wall including a locking piece insertion hole; and an insert locking piece having a locking protrusion for secondarily locking said short-circuit contact, when said insert locking piece is inserted into said locking piece insertion hole, whereby said base plate of said short-circuit contact is contacted with said locking protrusion of said insert locking piece to lock said short-circuit contact to said contact-support member.

2. A locking structure for doubly locking said short-circuit contact of the connector according to claim 1, wherein said base plate of said short-circuit contact comprises at least one locking protrusion, at least one locking recess is provided at the interior of said contact-support chamber of said one connector housing, and said short-circuit contact is locked to said contact-support chamber by engaging said locking protrusion with said locking recess.

3. A locking structure for doubly locking said short-circuit contact for the connector according to claim 1, wherein a portion of the short-circuit contact is locked at said base portion to the contact-support chamber of said one connector housing by force fit.

4. A locking structure for doubly locking said short-circuit contact for the connector according to claim 1 or 3, wherein said elastic contact pieces are formed by folding back a base plate in an arc shape and arranged in parallel with each other with a slit therebetween, a contact for short circuiting provided at an intermediate portion of each of said elastic contact pieces, an upraised portion provided at the free end of each elastic contact piece and a cover plate formed by bending said base plate thereof.

5. A locking structure for doubly locking said short-circuit contact for the connector according to claim 2, wherein said elastic contact pieces are formed by folding back a base plate in an arc shape and arranged in parallel with each other with a slit therebetween, a contact for short circuiting provided at an intermediate portion of each of said elastic contact pieces, and an upraised portion provided at the free end of each elastic contact piece, wherein said at least one locking protrusion is provided at a cover plate formed by bending said base plate thereof.

* * * * *